United States Patent [19]

Kellogg

[11] 4,356,777

[45] Nov. 2, 1982

[54] KNOCKDOWN STRUCTURE

[76] Inventor: Harlan F. Kellogg, 1617 Sprucewood, Rockford, Ill. 61107

[21] Appl. No.: 162,098

[22] Filed: Jun. 23, 1980

[51] Int. Cl.[3] ..... A47B 3/00

[52] U.S. Cl. ..... 108/111; 108/159; 312/257 R; 312/264

[58] Field of Search ..... 312/263, 264, 257 SM, 312/111, 257 R; 403/401, 404, 335, 336, 337; 108/109, 111, 107, 159; 211/134, 135; 217/12 R, 7, 65

[56] References Cited

U.S. PATENT DOCUMENTS

| | | | |
|---|---|---|---|
| 181,320 | 8/1876 | Donnell . | |
| 325,696 | 9/1885 | Post . | |
| 353,382 | 11/1886 | Schmidt . | |
| 408,278 | 8/1889 | White . | |
| 1,659,101 | 2/1928 | Harvey | 403/401 |
| 1,954,242 | 4/1934 | Heppenstall . | |
| 2,340,545 | 2/1944 | Marsh | 217/65 X |
| 2,457,836 | 1/1949 | Schofield . | |
| 2,801,895 | 8/1957 | Gass . | |
| 2,914,118 | 11/1959 | Sawyers | 297/440 |
| 3,012,678 | 12/1961 | Fiege | 108/109 |
| 3,269,068 | 8/1966 | King | 403/401 X |
| 3,295,902 | 1/1967 | Doutt | 312/263 X |
| 3,326,149 | 6/1967 | Mitchell et al. . | |

FOREIGN PATENT DOCUMENTS

| | | | |
|---|---|---|---|
| 1505538 | 11/1967 | France | 312/263 |
| 595625 | 7/1959 | Italy | 312/263 |

*Primary Examiner*—James T. McCall

*Attorney, Agent, or Firm*—Vernon J. Pillote

[57] ABSTRACT

A knockdown structure including at least two panels adapted to extend transverse to each other, an intermediate bar segment attached to a side face of one of the panels and two end bar segments attached to side face of the other of the panels and disposed at opposite ends of the intermediate bar segment. The intermediate and end bar segments have end faces in abutting relation when the bar segments are in alignment and the abutting end face on the intermediate and end bar segments define supplementary angles extending oblique to both of the panels at angles such that the intermediate bar segment forms a wedge type interlock with the end bar segments.

16 Claims, 15 Drawing Figures

Fig. 1.
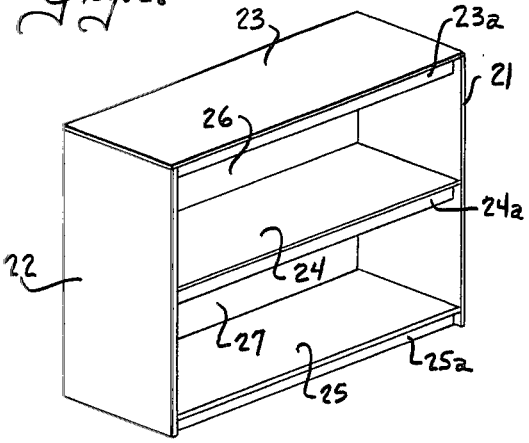
Fig. 2.
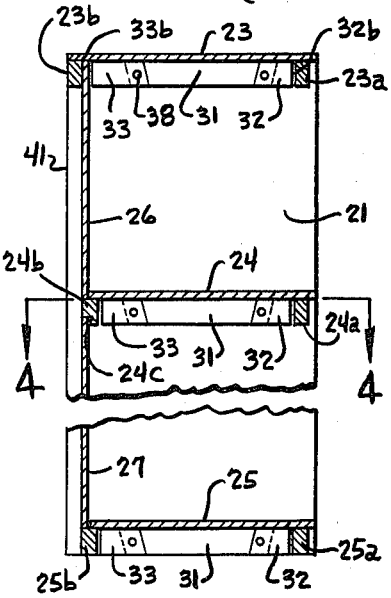
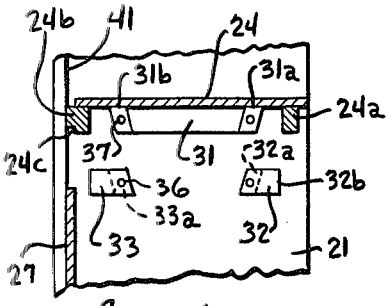
Fig. 3.
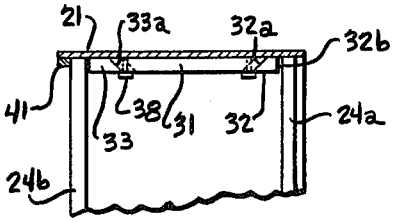
Fig. 4.
Fig. 5.
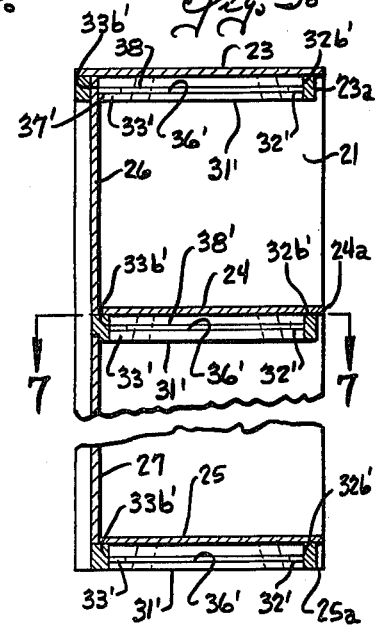
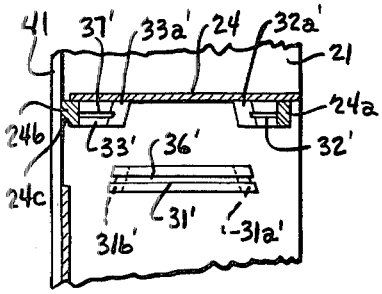
Fig. 6.
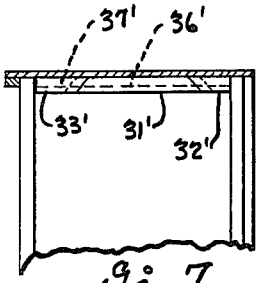
Fig. 7.

Fig. 8.
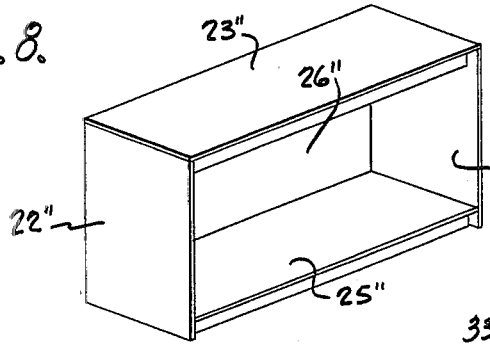
Fig. 14.
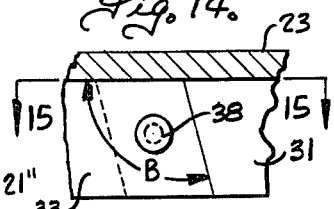
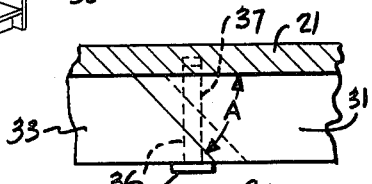
Fig. 15.
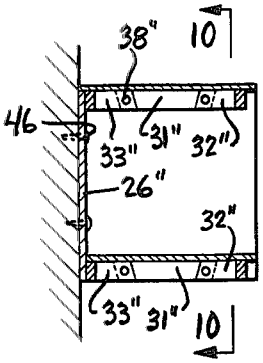
Fig. 9.
Fig. 10.
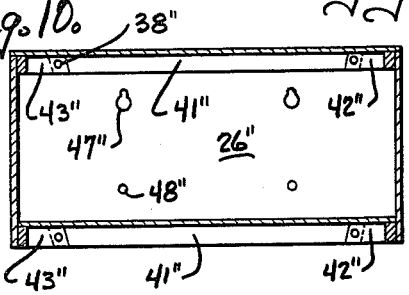
Fig. 11.
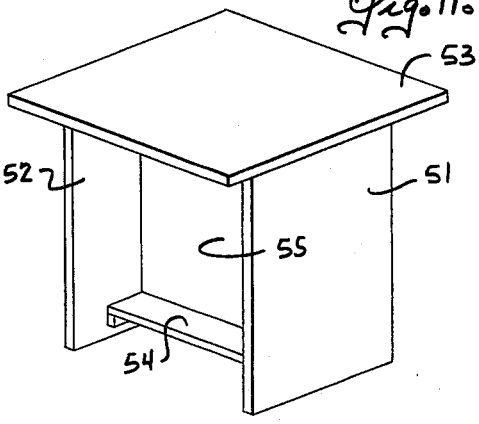
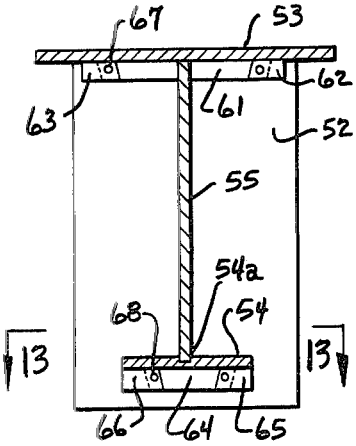
Fig. 12.
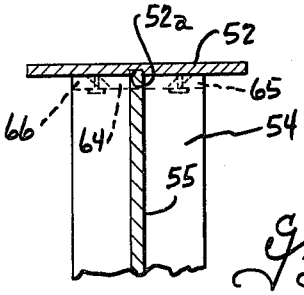
Fig. 13.

KNOCKDOWN STRUCTURE

SUMMARY OF THE INVENTION

The present invention relates to knockdown structures formed of interconnected panels. Such knockdown structures may, for example, include furniture structures such as cabinets, bookcases, desks, tables, chests, boxes, and utility structures such as shipping boxes, tool sheds, and dog houses.

Various important objects of this invention are to provide a knockdown structure formed of interconnected panels having an improved arrangement for detachably interconnecting the panels and which enables assembly and disassembly of the panels without the use of tools; which does not require expensive machining operations on the interconnecting portions of the panels; which rigidly interconnects the panels when they are assembled, and which provides a rigid and durable structure.

Accordingly, the present invention provides, in knockdown structure including first and second panels having side faces, a bar means for detachably interconnecting the first and second panels to extend transverse to each other, the bar means including an intermediate bar segment attached to a side face on the first panel and having end faces at opposite ends, two intermediate bar segments attached to a side face on the second panel and disposed at opposite ends of the intermediate bar segment and having end faces on adjacent ends in abutting relation to the end faces on the opposite ends of the intermediate bar segment when the first and second panels extend transverse to each other, the abutting end faces on the intermediate and end bar segments defining supplementary angles, the end faces on the bar segments attached to one of the panels each defining an included angle of less than 90° with the side face of that panel and the end faces on the bar segment attached to the other of the panels each defining an included angle of greater than 90° with the side face of that panel.

The interconnected panels are advantageously retained in assembled condition by removable locking means extending into the intermediate and end bar segments in a direction crosswise of the direction of relative movement of the panels during assembly.

These, together with other objects, features and advantages of this invention will be more readily understood by reference to the following detailed description, when taken in connection with the accompanying drawings wherein:

FIG. 1 is a perspective view of a bookcase embodying the panel interconnect system of the present invention;

FIG. 2 is a transverse vertical sectional view through the bookcase of FIG. 1;

FIG. 3 is a fragmentary vertical sectional view through the bookcase of FIG. 1 illustrating an intermediate shelf in an elevated position during assembly;

FIG. 4 is a fragmentary horizontal sectional view taken on the plane 4—4 of FIG. 2;

FIG. 5 is a transverse vertical sectional view through a bookcase illustrating a modified form of panel interconnect system;

FIG. 6 is a fragmentary vertical sectional view illustrating the intermediate shelf of the embodiment of FIG. 5 in a raised position during assembly;

FIG. 7 is a fragmentary horizontal sectional view taken on the plane 7—7 of FIG. 5;

FIG. 8 is a perspective view of a wall cabinet embodying the panel interconnect system of the present invention;

FIG. 9 is a transverse vertical sectional view through the cabinet of FIG. 8;

FIG. 10 is a longitudinal vertical sectional view taken on the plane 10—10 of FIG. 9;

FIG. 11 is a perspective view of a bench or desk embodying the panel interconnect system of the present invention;

FIG. 12 is a transverse vertical sectional view through the bench of FIG. 11;

FIG. 13 is a fragmentary horizontal sectional view taken on the plane 13—13 of FIG. 12;

FIG. 14 is a fragmentary vertical sectional view illustrating the abutting end faces on adjacent bar segments on a larger scale; and FIG. 15 is a fragmentary horizontal sectional view taken on the plane 15—15 of FIG. 14.

The present invention relates to knockdown structures formed of interconnected panels and may be utilized in a wide variety of furniture structures and utility structures. In the embodiment of FIGS. 1–4, the invention is shown applied to a bookcase having spaced upright panels 21 and 22 and a plurality of horizontal panels including an upper horizontal panel 23, one or more intermediate horizontal panels 24 and a lower horizontal panel 25. The bookcase also advantageously includes a rear wall herein shown formed by a plurality of panels 26 and 27.

The horizontal panels 23–25 extend transverse to the upright panels 21 and 22 and a bar means is provided for detachably interconnecting an end of each of the horizontal panels 23–25 to the upright panels 21 and 22. The bar means utilized for connecting an end of each horizontal panel to an upright panel are advantageously of similar construction and like numerals are utilized to designate corresponding parts. The bar means each include an intermediate bar segment 31 attached to the side face of one of the panels and two end bar segments 32 and 33 attached to the side face of the other of the panels and disposed at opposite ends of the intermediate bar segment. In the embodiment of FIGS. 1–4, the intermediate bar segments 31 are attached to the underside of the horizontal panels 23–25 adjacent the ends thereof, and the end bar segments 32 and 33 are attached to the inner face of the upright panels 21 and 22, at locations therealong corresponding to the desired positions of the several horizontal panels. The bar segments preferably have a generally rectangular cross section and the intermediate bar segment 31 has end faces **31*a* and 31*b* at opposite ends disposed in abutting relation to the end faces 32*a* and 33*a* on the adjacent ends of the end bar segments 32 and 33. The abutting end faces on the intermediate and end bar segments define supplementary angles and extend oblique to both the upright and horizontal panels. In the embodiment of FIGS. 1–4 in which the intermediate bar segments 31 are attached to the horizontal panels and the end bar segments 32 and 33 are attached to the upright panels, the end faces 32*a* and 33*a* on the end bar segments define an included angle designated A in FIG. 15 which is substantially less than 90° with the side face of the upright panels, and which is preferably of the order of about 45°. The end faces 31*a* and 31b on the intermediate bar segments attached to the horizontal panel, define an included angle designated B in FIG. 14, which is greater than 90° with the lower side face of the respective horizontal panel. The included angle B need only be slightly greater than 90° to facilitate assembly and to assure tight fit when assembled, and may, for example, be of the order of 105°. As used herein, the phrase "included angle" refers to the angle between the end face of a bar segment and the face of the panel to which it is attached, measured in a plane perpendicular to the panel and parallel to the length of the bar segment. With the above described arrangement, the end faces 31***a* and 31*b* on the intermediate bar segment attached to the horizontal panels are relatively convergent in a direction downwardly from the respective horizontal panel, to facilitate insertion of the intermediate bar segment between the end faces of the end bar segments, and to assure a tight fit between the end faces on the intermediate and end bar segments when they are in assembled relation as shown in FIGS. 2 and 4. In addition, the end faces 32*a* and 33*a* on the end bar segments attached to the upright panels are relatively convergent in a direction away from the respective upright panel so as to engage the respective end faces 31*a* and 31*b* on the intermediate bar segment 31 to firmly retain the ends of the horizontal panels against lateral and crosswise movement relative to the upright panels. Further, the intermediate bar segment 31 attached to the ends of the horizontal panels reinforces the horizontal panels and the end bar segments 32 and 33 underlie and support the ends of the horizontal panels, when the horizontal panels are assembled on the upright panels.

The interconnected panels are retained in assembled condition by removable locking means that extend into the intermediate and end bar segments in a direction crosswise of the direction of relative movement of the panels during assembly. In the embodiment of FIGS. 1–4, aligned holes 36 and 37 (FIG. 15) are formed in the adjacent ends of the intermediate and end bar segments at locations to extend generally horizontally and intersect the abutting end faces on the intermediate and end bar segments. The holes 36 and 37 can be formed in the ends of the intermediate and end bar segments prior to assembly on the respective panels or, alternatively, can be formed by drilling a hole through the overlapping ends of the intermediate end bar segment after the panels have been assembled. Headed pins 38 are pressed into the aligned openings 36 and 37 in the intermediate and end bar segments to hold the parts in assembled relation. If desired, the holes can be extended at least part way into the upright panels 21 and the pins made of a length to extend into the extended hole in the upright panel, to further aid in holding the parts in assembled relation.

In the bookcase structure shown in FIGS. 1–4, front rails 23*a*–25*a* are attached to the underside of the horizontal panels 23–25 respectively adjacent their forward edge. These rails not only reinforce the respective horizontal panels or shelves, but also overlie the forward end faces 32*b* of the bar segments 32, to shield the same from view. Rear rails 23*b*–25*b* are also advantageously attached to the horizontal panels 23–25 respectively adjacent their rear edges. The rear panels 26 and 27 are detachably retained between the horizontal panels and end panels. As shown in FIG. 2, the rear rail 25*b* is attached to the lower horizontal panel 25 so that the rear edge of the lower horizontal panel is offset slightly forward from the rear side of the rail 25*b*. The lower rear panel 27 rests on the lower rear rail 25*b* and the rear edge of the lower horizontal panel 25 provides a stop to limit forward movement of the panel 27. The rear rail 24*b* is also advantageously attached to the intermediae horizontal panel 24 with the rear edge of the intermediate panel offset forwardly from the rear side of the rail 24*b*. The upper panel 26 can rest directly on the rail 24*b* and the rear edge of the intermediate panel 24 provides a stop to limit forward movement of the panel 26. The rail 24*b* is also advantageously provided with a groove 24*c* along its lower rear edge for receiving the upper edge of the panel 27. The rail 23*b* is attached to the upper panel 23 adjacent its rear edge and is advantageously spaced from the rear end face 33*b* on the end bar segment 33 a distance to receive the upper portion of the panel 26 therebetween. Retaining strips 41 are provided on the upright panels adjacent their rear edges, to hold the panels 26 and 27 against rearward movement. Alternatively, the upright panels 21 can be provided with vertical grooves for receiving the ends of the panels 26 and 27.

The various panels including the upright panels 21 and 22 and horizontal panels 23–25 can be formed of various different materials and may, for example, be formed of wood, or wood composition board such as particle board or flake board. The bar segments may also be formed of various different materials but are preferably formed of wood. The bar segments are conveniently attached to the respective panels as by a suitable adhesive. Fastening means such as staples or nails may also be utilized to secure the bar segments to the panels, if desired.

The bookcase shown in the embodiment of FIGS. 5–7 is generally similar to that shown in FIGS. 1–4 and like numerals are used to designate corresponding parts, and like numerals followed by the postscript prime are used to designate modified parts. In the embodiment of FIGS. 5–7, the bar means is modified and the intermediate bar segments designated 31′ are attached to the upright panels 21 and the end bar segments 32′ and 33′ are attached to the underside of the horizontal panels 23–25. The abutting end face on the intermediate and end bar segments define supplementary angles and extend oblique to both the upright and horizontal panels. The end faces 31*a′* and 31*b′* on the intermediate bar segment 31′ define an included angle of less than 90° with the side faces of the respective upright panel, and the end faces 32*a′* and 33*a′* on the end bar segments 32′ and 33′ attached to the horizontal panels each define an included angle of greater than 90° with the side face of the horizontal panel. As shown, the end faces 31*a′* and 31*b′* on the intermediate bar segment define an included angle of about 45° with the side face of the respective upright panel, and the end faces 32*a′* and 33*a′* on the end bar segments define an included angle of about 105° with the underside of the respective horizontal panel. This embodiment also has a modified locking means for retaining the panels in assembled condition. As shown, aligned grooves 36′ and 37′ are provided in the faces of intermediate and end bar segments and an elongated strip or key 38′ is positioned in the grooves to extend across the adjacent ends of the intermediate end bar segments, to hold the parts in assembled relation. The strip or key 38′ can be formed of any suitable material and may, for example comprise a strip of wood, metal or plastic frictionally retained in the grooves. When the end bar segments are attached to the horizontal panels as shown in the embodiment of FIGS. 5–7, the front rails 23*a*–25*a* can be secured to the outer end faces 32*b′* of the bar segments 32'. Similarly, at least the lower and intermediate bar segments 25*b* and 26*b* can be attached to the outer end faces 33*b*' of the bar segments 33'. FIGS. 8–10 illustrate the invention applied to a wall mounted shelf or cabinet structure. The cabinet structure includes upright end panels 21" and 22", horizontal panels 23" and 25" and a rear panel 26". One or more intermediate shelves can be included in the cabinet, if desired. The ends of the horizontal panels 23" and 25" are attached to the upright panels by a bar means including an intermediate bar segment 31" and end bar segments 32" and 33". In addition, the horizontal panels 23" and 25" are attached along the rear edges to the rear panel 26" by a bar means including an intermediate bar segment 41" and end bar segments 42" and 43". The bar means utilized can be of the form shown in FIGS. 1–4 or the form shown in FIGS. 5–7. In the embodiment of FIGS. 8–10 the bar means is illustrated as of the form shown in FIGS. 1–4 in which the intermediate bar segments are attached to the underside of the horizontal panel and the end bar segments are attached to the inner faces of the upright panels. As more fully described in connection with FIGS. 1–4, the end face on the end bar segments attached to the upright panels define an included angle of less than 90° with the side faces of the upright panels and the end faces on the intermediate bar segments attached to the horizontal panels define an included angle of greater than 90° with the underside of the horizontal panels. Pins 38" are arranged to extend through aligned holes in the overlapping end faces of the intermediate and end bar segments, to hold the bar segments and the panels in assembled relation. The rear panel 26" can be mounted on an upright support such as a wall by fasteners 46 such as headed screws, lag bolts or the like. In order to facilitate mounting of the cabinet on the wall, the rear panel 26 can be formed with keyhole shaped openings 47" so that some of the fasteners 46 can be partially threaded into the wall before mounting the cabinet on the fasteners. Additional fastener receiving openings 48" can be provided for receiving additional fasteners for securing the cabinet in position.

The invention is shown applied to a bench or table-like knockdown structure in FIGS. 11–13. As shown, the table includes laterally spaced upright panels 51 and 52, a top panel 53, bottom panel 54 and an upright divider panel 55. The top horizontal panel 53 is attached to the upper ends of the uprights 51 and 52 by a bar means which includes an intermediate bar segment means 61 and end bar segments 62 and 63. The lower horizontal panel 54 is attached at its ends to the uprights 51 and 52 by a bar means including intermediate bar segment 64 and end bar segments 65 and 66. The bar means utilized can be of the form shown in FIGS. 1–4 or the form shown in FIGS. 5–7. In the embodiment shown, the intermediate bar segments are attached to the underside of the respective horizontal panel and the end bar segments are attached to the inner side faces of the upright panels. The end faces on the intermediate and end bar segments define supplementary angles that extend oblique to both are upright and horizontal panels. The end faces on the end bar segments attached to the upright panels each define an included angle of less than 90° with the side faces of the upright panels and the end faces on the intermediate bar segments attach to the underside of the horizontal panels each define an included angle of greater than 90° with the side face of the horizontal panel. Pins 67 and 68 are provided and arranged to extend through aligned openings in the overlapping end portions of the intermediate and end panels to hold the panels in assembled relation. The upright divider panel 55 has its ends disposed in grooves 52*a* in the upright end panel as shown in FIG. 13, and the upright divider panel extends between the lower horizontal panel 54 and the top panel 53, as shown in FIG. 12. The upper corners of the panel 55 can be notched to receive the intermediate bar segment 61. Alternatively, the bar segment means 61 can be formed in two sections which are spaced apart to receive the upright panel 55 therebetween. The upright panel rests on the lower horizontal panel 54 and the latter can be grooved as shown at 54*a* in FIG. 12 to receive the lower edge of the upright panel 55 to laterally stabilize the same. Instead of grooving the upright panels 51 and 52 to receive the ends of the divider panel 55, retaining strips could be attached to the upright panels 51 and 52 at opposite sides of the divider panel. While the divider panel is herein shown disposed medially between the longitudinal edges of the top panel, the divider panel and the bottom panel 54 could be located relatively closer to one or the other of the edges of the top panel to provide more knee room if desired.

While the invention has herein been shown and described in connection with several different forms of knockdown structures, it is apparent that the invention could be applied to other knockdown structures. For example, the invention can be utilized to make other furniture structures such as single or double pedestal desks, tables, chests, boxes and utility structures such as shipping boxes, tool sheds, dog houses and the like.

From the foregoing it is thought that the knockdown structure and the manner of constructing and assembling the same will be readily understood. The intermediate and end bar segments are attached as by adhesive to the side faces of the respective panels so that the bar segments are disposed in endwise aligned relation when the panels are in assembled condition. The abutting end faces on the intermediate and end bar segments define supplementary angles that extend oblique to both of the interconnected panels and the end faces on the bar segments attached to the upright panels define an included angle with that panel that is less than 90°, while the end faces on the bar segments attached to the horizontal panels define an included angle of greater than 90° with the side faces of the horizontal panels. The compound angle of the end faces on the intermediate and end bar segments is such that the intermediate bar segment forms a wedge fit between the end bar segments when the bar segments are in end-to-end alignment. This produces a tight joint between the bar segments and firmly holds the horizontal panel against movement laterally or crosswise with respect to the upright panels. The pins hold the bar segments in assembled relation. In addition, the bar segments reinforce and support the ends of the horizontal panels. The panels that extend transversely between the upright and horizontal panels, such as the rear panels in the bookcase and cabinet structures and the divider panel in the bench or table structure, further rigidify the knockdown structures.

The embodiments of the invention in which an exclusive property or privilege is claimed are defined as follows:

1. In a knockdown structure including first and second panels each having side faces, bar means for detachably connecting the first panel to the second panel to extend transverse thereto at a preselected location on the second panel, the bar means including:

(a) an intermediate bar segment means attached to one side face on one of the panels and having end faces on opposite ends;

(b) two end bar segment means attached to one side face on the other of the panels and disposed at opposite ends of the intermediate bar segment means and having end faces on adjacent ends in abutting relation to the end faces on opposite ends of the intermediate bar segment means when the first panel is positioned to extend transverse to the second panel at said preselected location;

(c) the abutting end faces on the intermediate and end bar segment means defining supplementary angles, at least one of the end faces on the bar segment means attached to the second panel defining an included angle of less than 90° with the side face of the second panel and at least one of the end faces of the bar segment means attached to the first panel defining an included angle of greater than 90° with the side face of the first panel, (d) the bar segment means attached to said one side face on said one of said panels having a panel engaging face extending transverse to said one side face of said one of said panels and engaging said one side face on the other of said panels when said first panel is at said preselected location on the second panel, the bar segment means attached to said one side face on said other of said panels having a panel engaging face extending transverse to said one side face on said other of said panels and engaging said one side face on said one of said panels when said first panel is in said preselected location on said second panel.

2. In a knockdown structure according to claim 1 including hole means in the intermediate and end bar segment means intersecting the pairs of abutting end faces and disposed in axial alignment when the intermediate and end bar segment means are in end-to-end relation, and locking pins extending through the hole means in the intermediate and end bar segment means.

3. In a knockdown structure according to claim 1 including aligned lengthwise extending recesses in the intermediate and end bar segments, and key means disposed in the recesses in the intermediate and end bar segments and extending therebetween.

4. In a knockdown structure including first and second panels each having side faces, bar means for detachably interconnecting the first and second panels to extend transverse to each other, the bar means including:

(a) an intermediate bar segment means attached to one side face on the first panel and having end faces at opposite ends;

(b) two end bar segment means attached to one side face on the second panel and disposed at opposite ends of the intermediate bar segment means and having end faces on adjacent ends in abutting relation to the end faces on opposite ends of the intermediate bar segment means when the first and second panels extend transverse to each other;

(c) the abutting end faces on the intermediate and end bar segment means defining supplementary angles, the end faces on the bar segment means attached to one of said panels each defining an included angle of less than 90° with the side face of that panel, and the end faces on the bar segment means attached to the other of the panels each defining an included angle of greater than 90° with the side face of that panel, (d) the end bar segment means attached to said second panel having a first panel engaging face extending transverse to said one side face on the second panel and engaging said one side face on the first panel when said first panel is at said preselected location on the second panel, the intermediate bar segment means attached to said first panel having a second panel engaging face extending transverse to said one side face on the first panel and engaging said one side face on the second panel when said first panel is at said preselected location on the second panel.

5. In a knockdown structure including at least one horizontal panel and one upright panel each having side faces, bar means for detachably connecting the horizontal panel to the upright panel to extend transverse thereto, the bar means including:

(a) an intermediate bar segment means attached to one side face on one of the panels and having end faces on opposite ends;

(b) two end bar segment means attached to one side face on the other of the panels and disposed at opposite ends of the intermediate bar segment means and having end faces on adjacent ends in abutting relation to the end faces on opposite ends of the intermediate bar segment means when the horizontal panel is positioned to extend transverse to the upright panel at said preselected location, (c) the abutting end faces on the intermediate and end bar segment means extending oblique to both the upright and horizontal panels, the end faces on the bar segment means attached to the upright panel each defining an included angle of less than 90° with the side face of the upright panel, and the end faces on the bar segment means attached to the horizontal panel each defining an included angle of greater than 90° with the side face of the horizontal panel, (d) the bar segment means attached to said one side face on said one of said panels having a panel engaging face extending transverse to said one side face of said one of said panels and engaging said one side face on the other of said panels when said first panel is at said preselected location on the second panel, the bar segment means attached to said one side face on said other of said panels having a panel engaging face extending transverse to said one side face on said other of said panels and engaging said one side face on said one of said panels when said first panel is in said preselected location on said second panel.

6. A knockdown structure according to claim 5 including removable locking means extending between the intermediate and end bar segment means for holding the panels in assembled relation.

7. In a knockdown structure including at least one horizontal panel and one upright panel each having side faces, bar means for detachably connecting the horizontal panel to the upright panel to extend transverse thereto, the bar means including:

(a) an intermediate bar segment means attached to a side face on one of the panels and having end faces on opposite ends;

(b) two end bar segment means attached to a side face on the other of the panels and disposed at opposite ends of the intermediate bar segment means and having end faces on adjacent ends in abutting relation to the end faces on opposite ends of the intermediate bar segment means when the horizontal panel is positioned to extend transverse to the upright panel at said preselected location, (c) the abutting end faces on the intermediate and end bar segment means extending oblique to both the upright and horizontal panels, the end faces on the bar segment means attached to the upright panel each defining an included angle of less than 90° with the side face of the upright panel, and the end faces on the bar segment means attached to the horizontal panel each defining an included angle of greater than 90° with the side face of the horizontal panel, (d) removable locking means extending between the intermediate and end bar segment means for holding the panels in assembled relation, (e) the intermediate bar segment means being attached to the upright panel and the two end bar segment means being attached to the horizontal panel, the end of the horizontal panel being supported on the intermediate bar segment means.

8. In a knockdown structure including at least one horizontal panel and one upright panel each having side faces, bar means for detachably connecting the horizontal panel to the upright panel to extend transverse thereto, the bar means including:

(a) an intermediate bar segment means attached to a side face on one of the panels and having end faces on opposite ends;

(b) two end bar segment means attached to a side face on the other of the panels and disposed at opposite ends of the intermediate bar segment means and having end faces on adjacent ends in abutting relation to the end faces on opposite ends of the intermediate bar segment means when the horizontal panel is positioned to extend transverse to the upright panel at said preselected location, (c) the abutting end faces on the intermediate and end bar segment means extending oblique to both the upright and horizontal panels, the end faces on the bar segment means attached to the upright panel each defining an included angle of less than 90° with the side face of the upright panel, and the end faces on the bar segment means attached to the horizontal panel each defining an included angle of greater than 90° with the side face of the horizontal panel, (d) removable locking means extending between the intermediate and end bar segment means for holding the panels in assembled relation, (e) the two end bar segment means being attached to the upright panel and the intermediate bar segment means being attached to the horizontal panel, the end of the horizontal panel being supported on the two end bar segment means.

9. In a knockdown structure including:

(a) at least two spaced apart upright panels each having inner and outer side faces;

(b) at least one horizontal panel having upper and lower side faces;

(c) horizontal bar means for attaching the ends of the horizontal panel to the spaced upright panels at a preselected location thereon, the horizontal bar means each comprising:

(1) first horizontal bar segment means attached to the inner side face of each upright panel at said preselected location and defining at least two end faces disposed oblique to the respective upright panel, (2) second horizontal bar segment means attached to the underside of the horizontal panel adjacent one end thereof and defining at least two end faces disposed oblique to the horizontal panel and in abutting relation to respective ones of said two end faces on the first bar segment means when the first and second bar segment means are in end-to-end relation, (3) the end faces on the first bar segment means each defining an included angle of less than 90° with the inner side face of the respective upright panel and the end faces on the second bar segment means each defining an included angle of greater than 90° with the underside of the horizontal panel, the abutting end faces on the first and second bar segment means defining supplementary angles.

(d) said horizontal panel resting on the first bar segment means when the horizontal panel extends between said vertical panels at said preselected location.

10. A knockdown structure according to claim 9 including removable locking means extending between the first and second horizontal bar segment means of each horizontal bar means for holding the same in assembled relation.

11. In a knockdown structure according to claim 9 wherein one of said horizontal bar segment means comprises an intermediate bar segment and the other of said horizontal bar segment means comprises end bar segments disposed at opposite ends of the intermediate bar segment.

12. In a knockdown structure according to claim 9 wherein said second bar segment means comprises an intermediate bar segment having said two end faces at opposite ends, said first bar segment means comprises two end bar segments disposed at opposite ends of the intermediate bar segment and having said two end faces on the adjacent ends of said two end bar segments.

13. In a knockdown structure according to claim 9 wherein said first bar segment means comprises an intermediate bar segment having said two end faces at opposite ends, said second bar segment means comprises two end bar segments disposed at opposite ends of the intermediate bar segment and having said two end faces on the adjacent ends of said two end bar segments.

14. In a knockdown structure including:

(a) at least two spaced apart upright panels each having inner and outer side faces;

(b) at least one horizontal panel having upper and lower side faces;

(c) horizontal bar means for attaching the ends of the horizontal panel to the spaced upright panels at a preselected location thereon, the horizontal bar means each comprising:

(1) first horizontal bar segment means attached to the inner side face of each upright panel at said preselected location and defining at least two end faces disposed oblique to the respective upright panel, (2) second horizontal bar segment means attached to the underside of the horizontal panel adjacent one end thereof and defining at least two end faces disposed oblique to the horizontal panel and in abutting relation to respective ones of said two end faces on the first bar segment means when the first and second bar segment means are in end-to-end relation, (3) the end faces on the first bar segment means each defining an included angle of less than 90° with the inner side face of the respective upright panel and the end faces on the second bar segment means each defining an included angle of greater than 90° with the underside of the horizontal panel, the abutting end faces on the first and second bar segment means defining supplementary angles, (d) a rear panel extending between said upright panels, rear horizontal bar means for attaching the rear portion of the horizontal panel to the rear panel, said rear horizontal bar means comprising:

(1) first rear bar segment means attached to the inner side face of the rear panel and defining at least two end faces disposed oblique to the rear panel, (2) second rear bar segment means attached to the horizontal panel adjacent the rear thereof and defining at least two end faces disposed oblique to the horizontal panel and in abutting relation to respective ones of the two end faces on the first rear bar segment means when the first and second rear bar segment means are in end-to-end relation, (3) the end faces on the first rear bar segment means each defining an included angle of less than 90° with the inner side of the rear panel and the end faces on the second rear bar segment means each defining an included angle of greater than 90° with the underside of the horizontal panel, the abutting end faces on the first and second rear bar segment means defining supplementary angles.

15. In a knockdown structure according to claim 14 including means for attaching the rear panel to an upright support.

16. In a knockdown structure including a first panel, second and third panels extending transverse to the first panel at spaced locations thereon, and a fourth panel extending transverse to each the first, second and third panels, first, second and third bar means for detachably connecting the fourth panel respectively to the first, second and third panels, each bar means including an intermediate bar segment means attached to a side face on one of the panels and having end faces on adjacent ends and two end bar segment means attached to a side face on another of the panels and disposed at opposite ends of the intermediate bar segment means and having end faces on adjacent ends in abutting engagement with the end faces on opposite ends of the intermediate bar segment means when said one and another of the panels extend transverse to each other, the abutting end faces on the intermediate and end bar segment means defining supplementary angles, the end faces on the bar segment means attached to the first, second and third panels each defining an included angle of less than 90° with the side face of the respective panel, the end faces of the bar segment means attached to the fourth panel each defining an included angle of greater than 90° with the side face of that panel.

* * * * *